US009810510B2

(12) United States Patent
Massaro, Jr.

(10) Patent No.: US 9,810,510 B2
(45) **Date of Patent: *Nov. 7, 2017**

(54) GUN HOLSTER WITH INFINITE POSITION ADJUSTMENT

(71) Applicant: Edward R. Massaro, Jr., Massillon, OH (US)

(72) Inventor: Edward R. Massaro, Jr., Massillon, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/420,908

(22) Filed: Jan. 31, 2017

(65) Prior Publication Data

US 2017/0153087 A1 Jun. 1, 2017

Related U.S. Application Data

(63) Continuation of application No. 14/861,515, filed on Sep. 22, 2015, now Pat. No. 9,581,413.

(60) Provisional application No. 62/057,560, filed on Sep. 30, 2014.

(51) Int. Cl.

| | |
|---|---|
| ***F41C 33/00*** | (2006.01) |
| ***F41C 33/02*** | (2006.01) |
| ***F41C 33/04*** | (2006.01) |

(52) U.S. Cl.

CPC ..... *F41C 33/04* (2013.01); *F41C 33/0209* (2013.01); *F41C 33/0227* (2013.01)

(58) Field of Classification Search

CPC ..... A01K 97/10; A45F 3/04; F41C 33/0209; F41C 33/0227; F41C 33/04

USPC ..... 224/581, 192, 193, 198, 238

See application file for complete search history.

(56) References Cited

U.S. PATENT DOCUMENTS

| | | | | |
|---|---|---|---|---|
| 2,910,804 | A * | 11/1959 | White | F41C 33/0263 2/300 |
| 4,022,361 | A * | 5/1977 | Devlin | A45F 5/021 224/192 |
| 4,258,871 | A * | 3/1981 | McMahon | F41C 33/0209 224/192 |
| 6,990,887 | B1 * | 1/2006 | O'Donnell | F41H 5/08 89/36.02 |
| 8,479,331 | B2 * | 7/2013 | Craighead | F41C 33/041 5/503.1 |
| 9,581,413 | B2 * | 2/2017 | Massaro, Jr. | F41C 33/04 |

* cited by examiner

*Primary Examiner* — Nathan J Newhouse
*Assistant Examiner* — Lester L Vanterpool
(74) *Attorney, Agent, or Firm* — Black, McCuskey, Souers & Arbaugh LPA

(57) ABSTRACT

In accordance with an example embodiment, there is disclosed herein a holster that provides for infinite adjustment and positioning of a gun and gun grip in a concealed or unconcealed location on a person. Accordingly the same holster can be used by a right-handed or left-handed shooter, and by either in a strong side or cross-draw position.

20 Claims, 9 Drawing Sheets

GUN HOLSTER WITH INFINITE POSITION ADJUSTMENT

CROSS REFERENCE TO RELATED APPLICATIONS

This application is a continuation of U.S. patent application Ser. No. 14/861,515 filed on Sep. 22, 2015, which claims priority from U.S. Provisional Application No. 62/057,560 filed Sep. 30, 2014, the entire contents of which are hereby incorporated by reference.

TECHNICAL FIELD

The present disclosure relates generally to firearm accessories such as holsters.

BACKGROUND

Handguns can be carried in a concealed manner in a wide variety of ways, from simply concealing or holding in clothes pockets or compartments to the use of carrying device or holster which is partially or completely covered by clothing. A wide variety of holsters for handguns have been created, including relatively compact or low profile designs which conform tightly to the barrel and trigger guard of a handgun such as bolt action type handguns. Typical configurations include a cover piece which is shaped to closely conform to the side profile of the barrel and trigger guard, and which is permanently attached to a back piece which is against or in close proximity to the body. With these types of holsters, because the orientation of the receiver is fixed with respect to the back piece, the entire holster must be moved or positionally adjusted in order to have the gun grip at a preferred orientation angle for the wearer.

Overview of Example Embodiments

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein a holster that provides for infinite adjustment and positioning of a gun and gun grip in a concealed or unconcealed location on a person. Accordingly the same holster can be used by a right-handed or left-handed shooter, and by either in a strong side or cross-draw position.

BRIEF DESCRIPTION OF THE DRAWINGS

The accompanying drawings incorporated herein and forming a part of the specification illustrate the example embodiments.

DESCRIPTION OF EXAMPLE EMBODIMENTS

Figure 1:
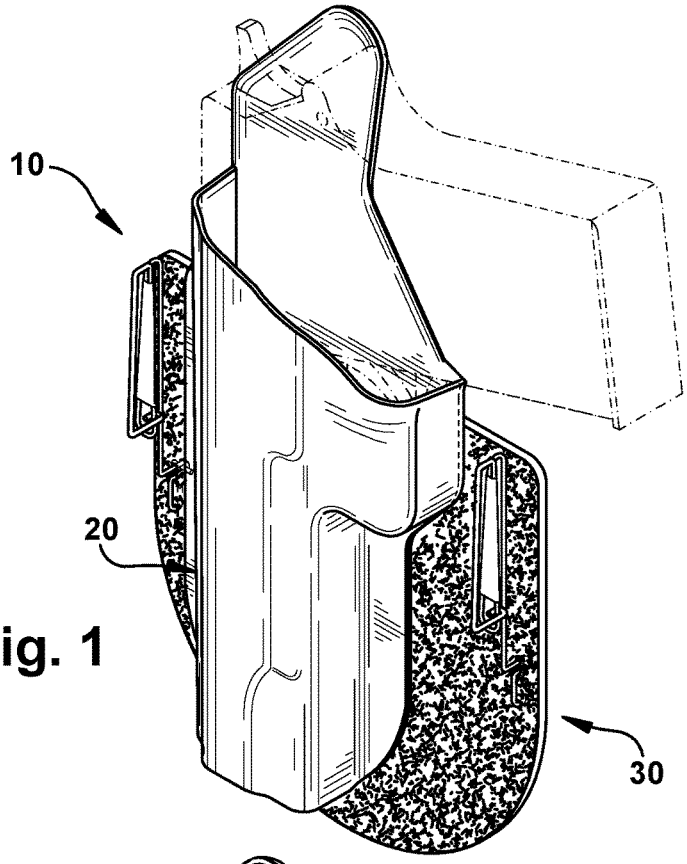
FIG. 1 is a perspective view of a first embodiment of a holster of the present disclosure.

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

Figure 3:
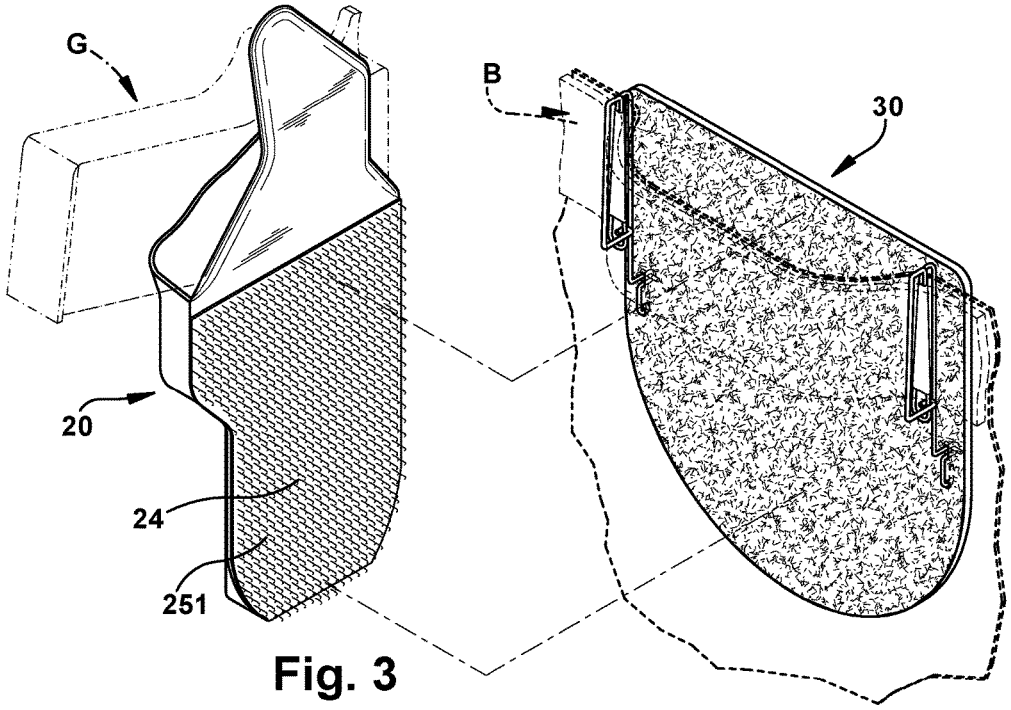
FIG. 3 is an alternate perspective assembly view of the holster of FIG. 1.
Figure 4:
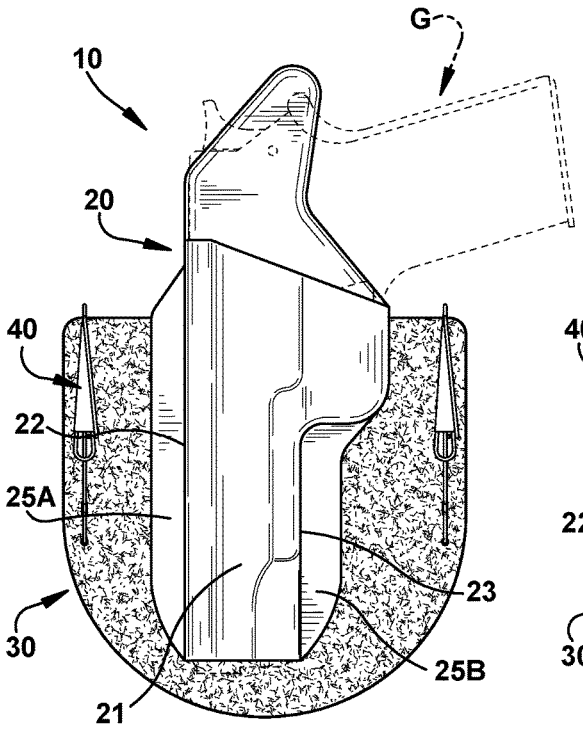
FIG. 4 is a profile view of a holster of the present disclosure in a first representative configuration.
Figure 5:
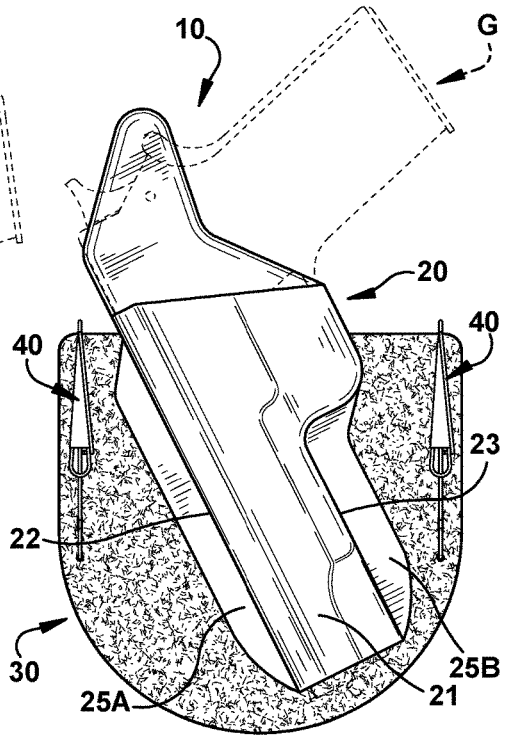
FIG. 5 is a profile view of a holster of the present disclosure in a second representative configuration.
Figure 6:
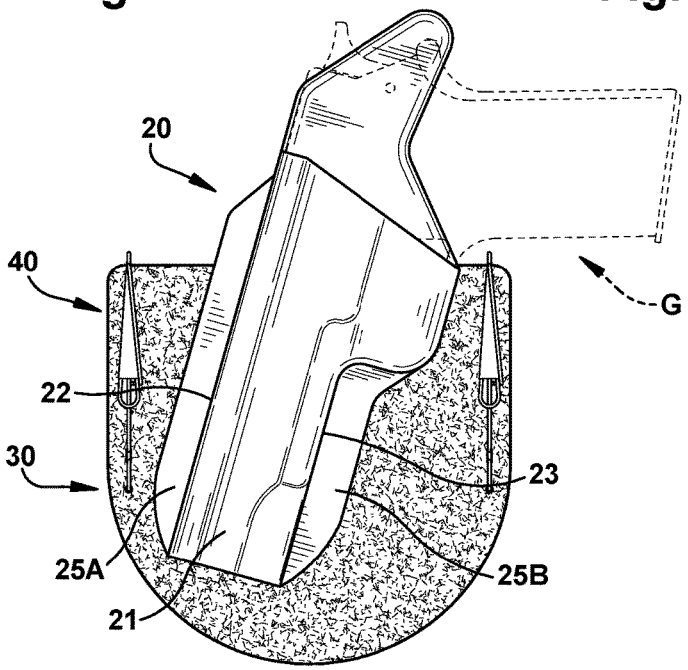
FIG. 6 is a profile view of a holster of the present disclosure in a third representative configuration.

As illustrated by the Figures, a holster indicated generally at 10 is generally configured for removably holding a gun, such as a handgun such as a bolt-action type pistol. The holster 10 includes the primary components of a shroud or cover 20 and a back 30. The cover 20 is preferably made of a single piece of formed material such as plastic or leather or other formable sheet material, and to preferably be formed with contours, including an outer wall 21 and side walls 22 and 23, which fit closely with an exterior profile of the gun G, such as the barrel, trigger guard and other portions of the gun G, and generally leaving the gun grip outside of the cover 20. The cover 20 may be substantially enclosed, for example by a rear panel 24 as shown in FIG. 3, or be configured with an open rear side as shown in FIG. 7.

Figure 2A:
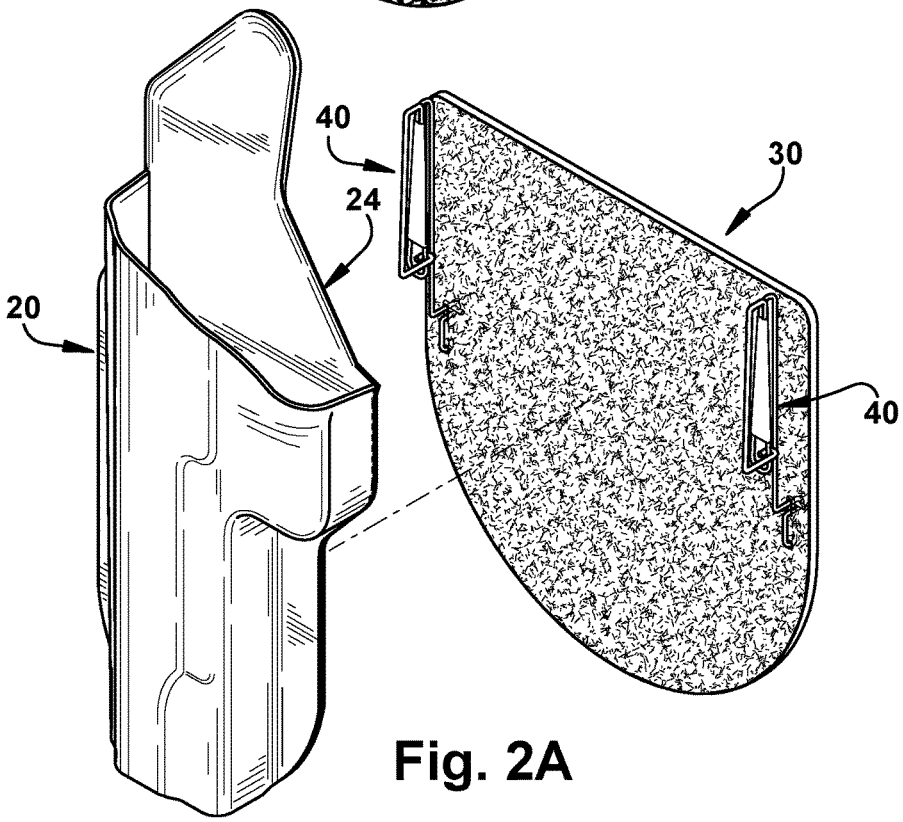
FIG. 2A illustrates an exploded assembly view of the holster in FIG. 1.
Figure 2B:
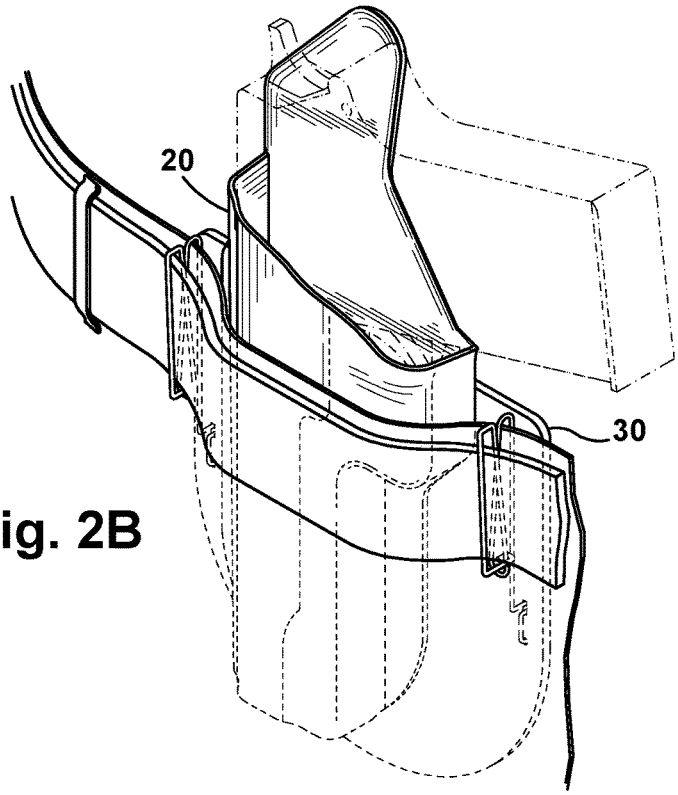
FIG. 2B illustrates an example of the hostler in FIG. 1 worn inside a garment.
Figure 2C:
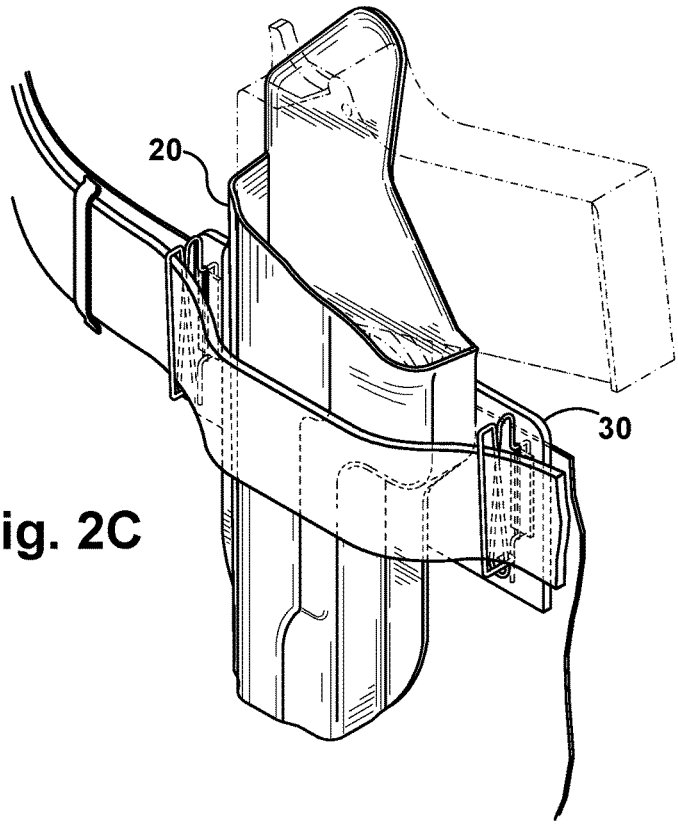
FIG. 2C illustrates an example of the holster in FIG. 1 worn outside a garment.

In an example embodiment, the cover 20 further includes flanges 25A and 25B which extend generally laterally of the outer wall 21 and side walls 22, 23. The flanges 25A and 25B are generally planar, substantially co-planar and preferably extend substantially along the length of the cover 20. The flange 25A preferably extends substantially along the length of side wall 22, and flange 25B extends along side wall 23, for example from a trigger guard receiving area of the cover 20 to a muzzle end of the cover 20. The muzzle end may be open or closed according to the configuration of the cover 20. In one embodiment, at least one dimension of the cover 20 is greater than a dimension of the back 30 such that the cover 20 extends beyond an edge of the back 30, as illustrated in FIG. 2C.

Figure 8:
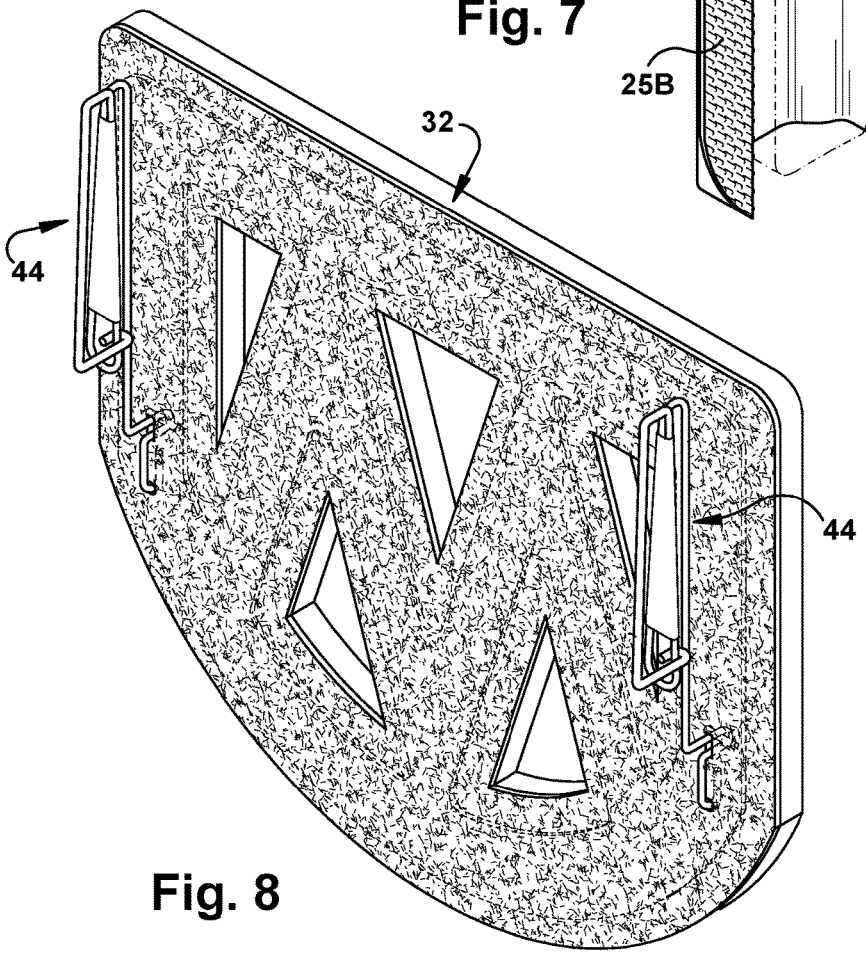
FIG. 8 is a perspective view of a component of the holster of the present disclosure.
Figure 10:
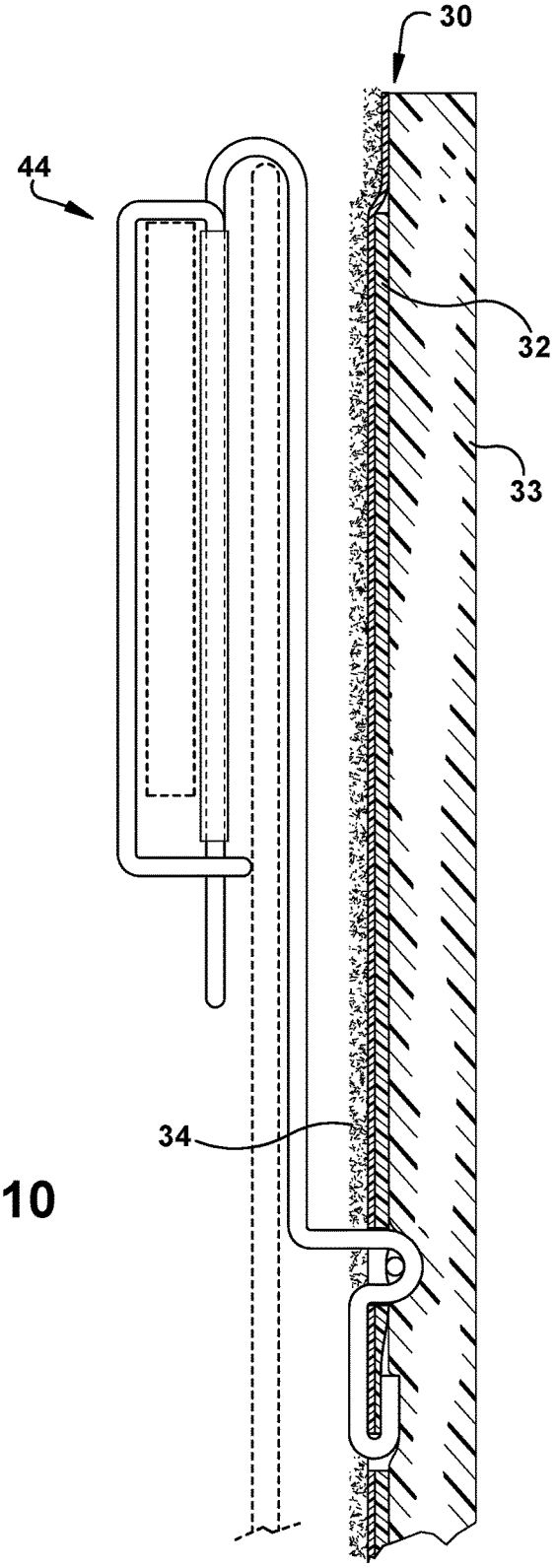
FIG. 10 is a cross-sectional view of a portion of a holster of the present disclosure.
Figure 11:
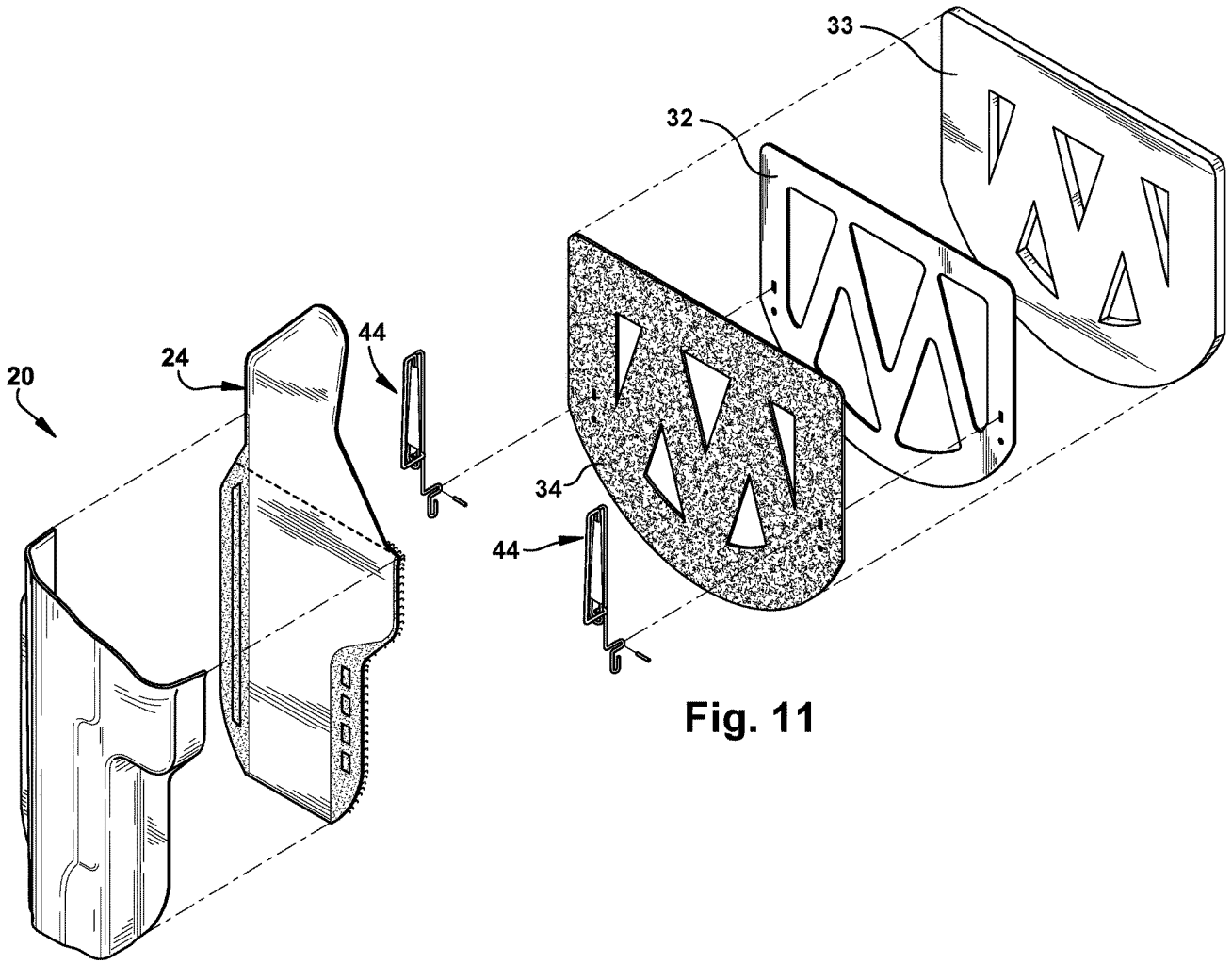
FIG. 11 is an exploded view of an example embodiment.

The back 30 of the holster is substantially planar, and can have an exterior profile 31 of any desired shape. The back 30 is preferably made of flexible sheet material, such as plastic or leather, and may include several layers of material as shown in FIG. 10, including a core layer 32, an inner layer 33 and an outer layer 34. Representative materials for the layers are plastic for the core layer 32, neoprene or rubber or polymeric material for the inner layer 33, and the outer layer 34 comprises a reusable fastener material. In an example embodiment, as illustrated in FIGS. 8 and 11, openings are provided in the core layers 32, 33, and 34 in order to allow air flow through the back 30, i.e. through the inner and outer layers.

Figure 7:
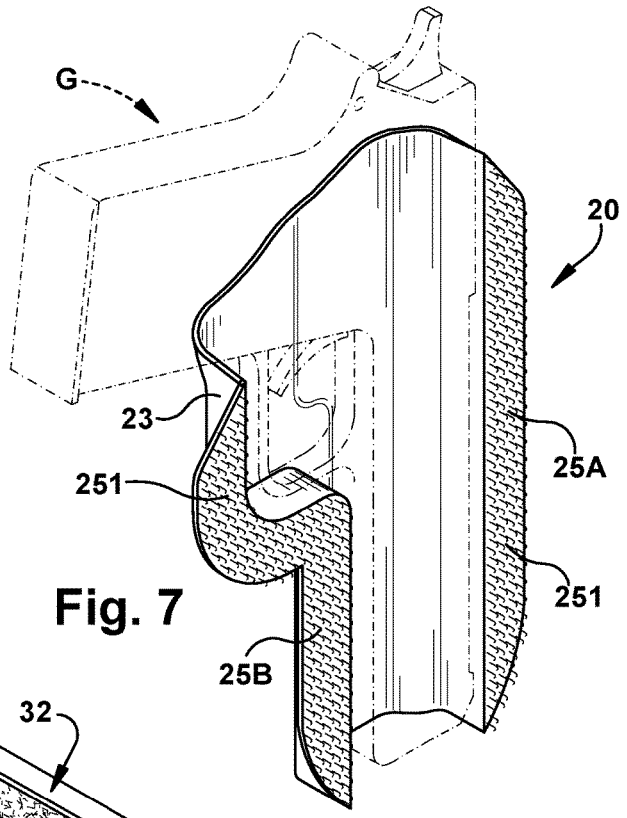
FIG. 7 is perspective view of an alternate embodiment of a holster of the present disclosure.
Figure 9A:
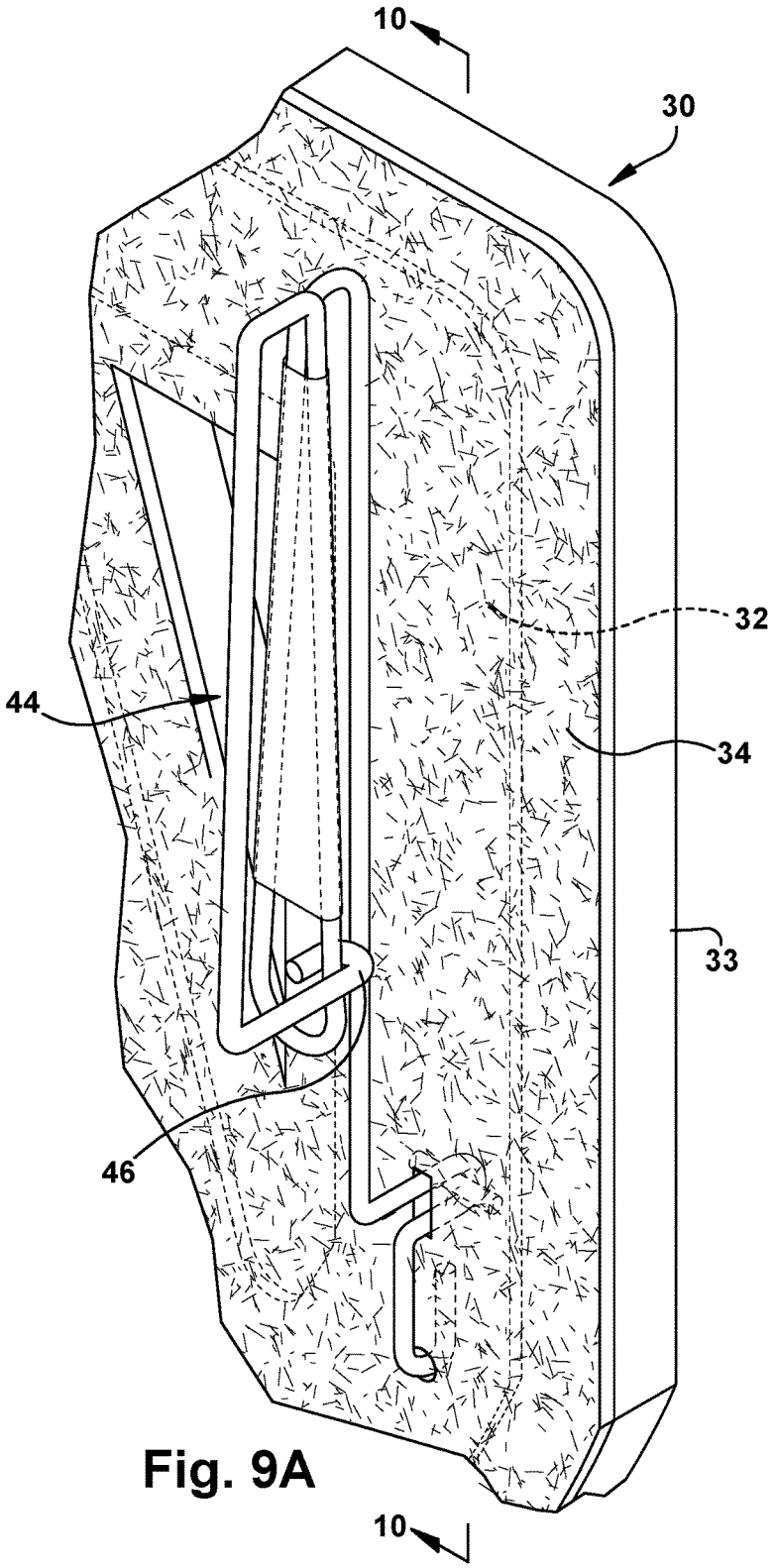
FIG. 9A illustrates an example of the holster with wired clips.
Figure 9B:
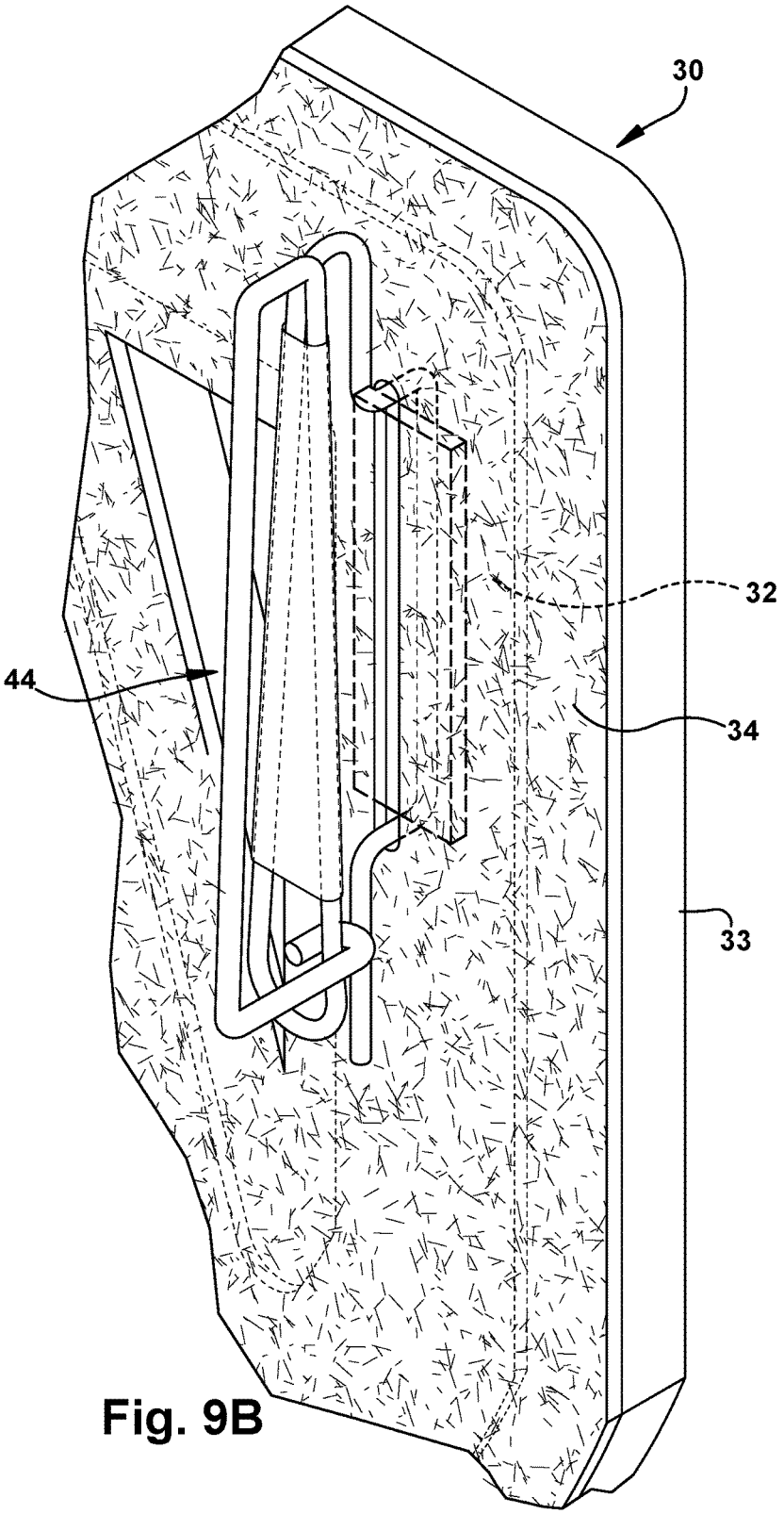
FIG. 9B illustrates an example of the holster that that includes an anchoring loop that extends through the back of the holster.

In an example embodiment, illustrated in FIG. 7, on the rear side of the flanges 25A, 25B is applied a first reusable fastener material 251 for engaging contact with the corresponding material of the outer layer 34 of the back 30. In another example embodiment, as illustrated in FIG. 3, the first reusable fastener material 251 is applied to the rear panel 24. In yet another example embodiment, the first reusable fastener material 251 forms the rear panel 24. In any of the aforementioned embodiments, the cover 20 can thus be securely attached to the back 30 in any possible orientation, as shown for example in FIGS. 1 and 4-6 or in any other possible location and orientation for infinite adjustment of the orientation of the cover 20 on the back 30. The almost infinite possible positioning of the cover 20 on the back 30 allows the holster 10 to be custom fit for any user and any hand gun for which the cover 20 is configured. This includes wearing of the holster 10 in a fully concealed manner, for example inside the belt region of pants P or skirt, or in any position in which the back 30 is attached or mounted, and for strong side or conventional drawing right or left-handed, cross drawing or any other use location and draw method. Clips 40 are provided on the back 30, for example on the facing side for engagement with a belt B, waistband or other article of clothing or securement device, as illustrated. The clips may include a clip body 41 and spring 42 as shown in FIGS. 1-3, or in wire form as shown in FIGS. 8-10. In the wire form, a spring 44 can be formed to provide a belt loop, which is spaced from the back 30 as illustrated, and an anchoring loop which extends partially or entirely through the back 30. In particular embodiments, the clip 40 has a hook 46 that can allow the back to be disengaged from a belt without the user having to remove their belt.

As those skilled in the art can readily appreciate, the first reusable fastener materials may be any suitable materials that can be reused for the purpose of bonding or joining the cover 20 and back 30. For example, for a hook and loop fastener, the first reusable fastener material 251 comprises the hook and the outer layer (second reusable fastener material) 34 comprises the loop, or visa versa (e.g., the first reusable material is the loop and the second reusable material is the hook). Other suitable reusable fastener materials include, but are not limited to flexible magnetic fields, high coefficient of friction materials, high friction rubber or polymers, building blocks, (e.g., LEGO), suction/vacuum couplers, or any flexible or spaced non-flexible material that can be reusable for the purpose of bonding or joining the cover 20 to the back 30.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

The invention claimed is:

1. A gun holster comprising:

a cover configured with three walls contoured to fit closely with an exterior profile of a gun and an open rear side, the cover having an outer wall, first and second side walls, and first and second flanges, the first and second flanges extending outwardly laterally of the first and second side walls, a first reusable fastener material applied to the first and second flanges; and a back having an inner side and an outer side, a second reusable fastener material applied to the outer side of the back, the second reusable fastener material engageable with the first reusable fastener material on the first and second flanges;

wherein the cover is engaged with the back to form an enclosure for receiving a portion of the gun; and the back further comprises a clip, the clip having a clip body portion, a spring formed to provide a belt loop which is spaced from the back, and an anchoring loop which extends at least partially through the back.

2. The gun holster set forth in claim 1, wherein the first and second reusable fastener materials are a hook and loop material.

3. The gun holster set forth in claim 1, wherein the cover is formed of a single piece of material.

4. The gun holster set forth in claim 1, wherein the back is formed of a flexible sheet material.

5. The gun holster set forth in claim 1, wherein the first and second flanges extend along the length of the side walls.

6. The gun holster set forth in claim 1, wherein the clip is formed of wire.

7. The gun holster set forth in claim 6, wherein the clip comprises a hook that allows the clip to open.

8. A gun holster comprising:

a cover, the cover having an outer wall, first and second side walls, and a rear panel, a first reusable fastener material applied to the rear panel; and a back having an inner side and an outer side, a second reusable fastener material applied to the outer side of the back, the second reusable fastener material engageable with the first reusable fastener material; and a clip, the clip having a clip body portion, a spring formed to provide a belt loop which is spaced from the back, and an anchoring loop which extends at least partially through the back;

wherein the outer wall, first and second side walls, and the rear panel form an enclosure for receiving a portion of a gun.

9. The gun holster set forth in claim 8, wherein the first and second reusable fastener materials are a hook and loop material.

10. The gun holster set forth in claim 8, wherein the first and second reusable fastener materials are high friction rubber.

11. The gun holster set forth in claim 8, wherein the first and second reusable fastener materials are magnetic.

12. The gun holster set forth in claim 8, wherein the first and second reusable fastener materials are flexible polymers.

13. The gun holster set forth in claim 8, wherein the cover is formed of a single piece of material.

14. The gun holster set forth in claim 8, wherein the back is formed of a flexible sheet material.

15. The gun holster set forth in claim 8, wherein the clip is formed of wire.

16. The gun holster set forth in claim 8, wherein the clip comprises a hook that allows the clip to open.

17. The gun holster set forth in claim 8, the cover further comprises first and second flanges, wherein the first and second flanges extend outwardly laterally of the first and second side walls.

18. A gun holster comprising:

a cover, the cover having an outer wall, first and second side walls, and a rear panel, a first reusable fastener material applied to the rear panel; and a back having an inner side and an outer side, a second reusable fastener material applied to the outer side of the back, the second reusable fastener material engageable with the first reusable fastener material; and a clip coupled with the outer side of the back, the clip formed to provide a belt loop which is spaced from the back;

wherein the outer wall, first and second side walls, and the rear panel form an enclosure for receiving a portion of a gun.

19. The gun holster set forth in claim 18, further comprising a second clip coupled with the outer side of the back, the second clip formed to provide a belt loop which is spaced from the back.

20. The gun holster set forth in claim 18, wherein the first and second reusable fastener materials are a hook and loop material.

* * * * *